US011260651B2

(12) United States Patent
Kambayashi

(10) Patent No.: US 11,260,651 B2
(45) Date of Patent: Mar. 1, 2022

(54) DUST REMOVAL DEVICE AND PRINTER

(71) Applicant: RISO KAGAKU CORPORATION, Tokyo (JP)

(72) Inventor: Takuya Kambayashi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/790,034

(22) Filed: Feb. 13, 2020

(65) Prior Publication Data

US 2020/0262196 A1 Aug. 20, 2020

(30) Foreign Application Priority Data

Feb. 20, 2019 (JP) ..... JP2019-028037

(51) Int. Cl.
*B41F 23/00* (2006.01)
*B41F 35/00* (2006.01)
*B65H 20/02* (2006.01)

(52) U.S. Cl.
CPC ..... *B41F 23/002* (2013.01); *B41F 35/00* (2013.01); *B65H 20/02* (2013.01); *B65H 2301/5115* (2013.01)

(58) Field of Classification Search
CPC ..... B41F 23/002
USPC ..... 101/425
See application file for complete search history.

(56) References Cited

U.S. PATENT DOCUMENTS 3,986,223 A * 10/1976 Kiefer ..... B08B 6/00 15/1.51
4,982,469 A * 1/1991 Nishiwaki ..... B41F 23/002 15/102
6,178,589 B1 * 1/2001 Kaim ..... B41F 23/002 101/425
2002/0152909 A1 * 10/2002 Corrado ..... B08B 7/0028 101/425

(Continued)

FOREIGN PATENT DOCUMENTS

JP 2009-202449 9/2009
JP 2015-217539 A 12/2015
JP 2017-52158 A 3/2017

OTHER PUBLICATIONS

Extended Search Report, European Patent Office, Application No. 20158526.2, dated Jul. 28, 2020.

*Primary Examiner* — Anthony H Nguyen
(74) *Attorney, Agent, or Firm* — Greenblum & Bernstein, P.L.C.

(57) ABSTRACT

A dust removal device for continuous paper improves operability and usability for a user. The continuous paper is continuously supplied in a rightward direction, then through guide rollers, the direction of the continuous paper is reversed leftward. A downward front surface of the continuous paper is cleaned with a first dust removal device. Further, a direction of the continuous paper is reversed with a guide roller rightward. A downward back surface of the continuous paper is cleaned with a second dust removal device, and is guided to the downstream side. The two dust removal devices are provided in a vertical positional relationship in space. Dust removed with a dust removing member falls to a dust receiving member and is stored in the dust receiving member. It is possible to easily dispose the (Continued)

dust by pulling out the dust removal device from a cleaning position to an outside detachment position.

6 Claims, 9 Drawing Sheets

(56) References Cited

U.S. PATENT DOCUMENTS

| | | | | |
|---|---|---|---|---|
| 2004/0076458 | A1 | 4/2004 | Itou | |
| 2011/0043554 | A1 | 2/2011 | Silverbrook et al. | |
| 2011/0268483 | A1* | 11/2011 | Thayer | G03G 15/6573 399/353 |
| 2011/0277652 | A1* | 11/2011 | Cyr | G03G 15/6573 101/425 |
| 2013/0084096 | A1 | 4/2013 | Hashimoto | |

* cited by examiner

DUST REMOVAL DEVICE AND PRINTER

BACKGROUND OF THE INVENTION

The present invention relates to a dust removal device useful for removal of dust attached to continuous paper which is a continuous band-shape long body.

A printer having a function of feeding and conveying continuous paper in a rolled condition (rolled paper) from a paper supply part and at the same time printing a desired image with a printing part on the continuous paper, and winding the printed continuous paper, is known. In some cases, minute unnecessary objects such as paper powder occurred in manufacturing process or the like and dust existing in the environmental atmosphere (in the present specification, these objects will be referred to as "dust") are attached to the surface of the rolled paper used in this printer. Such dust becomes a factor to cause various troubles. For example, the dust may cause cloaking in nozzles of an ink-jet head to cause printing failure in the printer.

An invention in a printer having a destaticizing brush as paper dust removal member in a conveyance path of the continuous paper, to eliminate paper powder attached to the continuous paper, has been proposed (e.g., Japanese Published Unexamined Patent Application No. 2009-202449). According to this technique, the destaticizing brush is provided in a paper supply port, and when the paper is passed through the paper supply port, the paper powder is removed by contact between the destaticizing brush and the surface of the paper.

In the above-described printer using rolled paper, prior to printing, it is necessary to perform preparation work to set the rolled paper in the paper supply part, pull the rolled paper from the paper supply part, and draw the rolled paper along the conveyance path of a continuous paper conveyance member, then connecting the rolled paper to a paper winding part for winding printed rolled paper. In this printer using rolled paper, when a dust removal unit to come into contact with the paper to remove dust as in the case of the above-described paper powder removing member is fixedly attached to a predetermined position in the printer as a countermeasure for paper powder, the above-described preparation work to draw the rolled paper has been difficult.

When the dust removing unit is fixedly provided in a position where the dust removing unit is in contact with the rolled paper in the conveyance path, upon drawing the rolled paper along the conveyance path, the rolled paper and the dust removing unit interfere with each other. It is not easy to efficiently arrange the rolled paper in the conveyance path without loading or damaging the rolled paper and obtain an appropriate contact state between the rolled paper and the dust removing unit.

Further, the arrangement of the rolled paper in the conveyance path changes in accordance with the manner of drawing of the rolled paper, and as a result, the contact state between the dust removing unit and the rolled paper changes. In this case, when the rolled paper has been set, it is necessary to adjust the position of the dust removing unit, and then, again adjust the position of the rolled paper. Thus, the above configuration has had inconvenience in the operability for the user.

Further, as normal usage of this type of printer, it is conceivable that when time of use of the printer becomes a predetermined reference value, and it is considered that the dust removing unit is dirty with paper powder and requires cleaning, the printer is stopped, and the dust removing unit is cleaned. However, according to this usage, since the printer is being used and the rolled paper exists in the conveyance path, the rolled paper disturbs cleaning of the dust removal device in contact with the rolled paper. That is, it is difficult to clean the dust removing unit in this state. When the rolled paper does not exist and the dust removing unit is cleaned at this time, such problem does not occur. However, the timing of cleaning is limited to e.g. a previous stage of the above-described preparation work.

SUMMARY OF THE INVENTION

The present invention has been made in view of the above-described conventional technique and the problems, and provides a dust removal device, having a dust removing member to remove dust attached to conveyed continuous paper, to improve operability and convenience for the user in setting and cleaning of the dust removing member.

The dust removal device according to the present invention has a dust removing member which is movable between a cleaning position where the dust removing member is in contact with continuous paper conveyed in horizontal posture in predetermined space, and a detachment position away from the space.

According to the dust removal device according to the present invention, to remove dust attached to the continuous paper, the dust removing member is set in the cleaning position where the dust removing member is in contact with the continuous paper in horizontal posture, and conveyance of the continuous paper is started. The dust attached to the continuous paper is rubbed with the dust removing member in accordance with conveyance of the continuous paper and is removed from the continuous paper. To clean the dust removing member, in a state where the conveyance of the continuous paper is stopped, the dust removing member in the cleaning position is moved to the detachment position. The dust removing member is moved out of predetermined space, then released from the contact with the continuous paper. Since the dust removing member does not interfere with continuous paper, it is possible to easily clean the dust removing member dirty with the dust. Further, by moving the dust removing member to the detachment position, the predetermined space becomes empty. It is possible to easily perform the work to set the continuous paper.

DETAILED DESCRIPTION OF THE PREFERRED EMBODIMENTS

Hereinbelow, a dust removal device 100 according to a first embodiment of the present invention, and an ink-jet printer 1 having the dust removal device 100 will be described with reference to FIG. 1.

Figure 1:
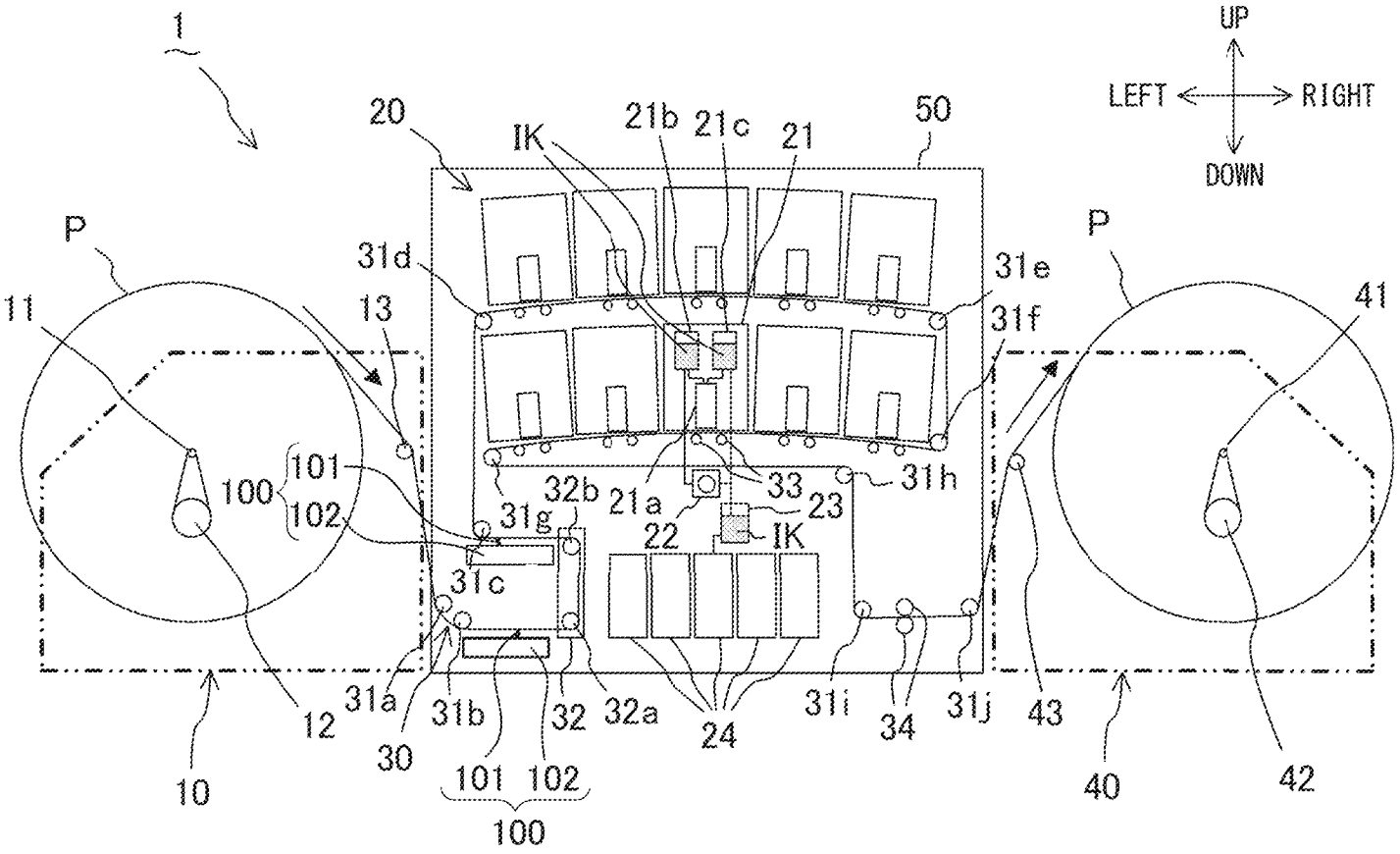
FIG. 1 is a schematic cross-sectional view of the entire configuration of an ink-jet printer in embodiments of the present invention.

FIG. 1 is a configuration diagram of the ink-jet printer 1 according to the first embodiment viewed from the front side. In FIG. 1, the up-and-down direction, the right-and-left direction (the two directions are indicated with arrows in FIG. 1) and the front-and-back direction (in FIG. 1, the vertical direction of the drawing) are merely terms of address for the sake of convenience. More particularly, the up-and-down direction is a vertical direction. The right-and-left direction and the front-and-back direction are directions orthogonal to each other in a horizontal plane.

As shown in FIG. 1, the ink-jet printer 1 has an unwinder 10 as a paper supply part which feeds continuous paper P, a printing part 20 which performs printing on the continuous paper P fed from the unwinder 10, a conveyance unit 30 which conveys the continuous paper P, a winder 40 as a winding part which winds the printed continuous paper P, a housing 50, and two dust removal devices 100. The dust removal device 100 will be described in detail later.

The ink-jet printer 1 shown in FIG. 1 performs printing on the long-band-shaped continuous paper P which is a web (roll paper) in a rolled condition. The continuous paper P is an example of the continuous medium. As the continuous medium, other media than the paper such as a film may be used. Further, as the ink-jet printer 1, a printer in which the unwinder 10 and the winder 40 are provided independently of the ink-jet printer 1, i.e., an ink-jet printer without the unwinder 10 and the winder 40 may be used. That is, the printer may have a structure where the unwinder 10 and the winder 40 are added as separate bodies to the printing part 20. Further, the printing method is not limited to the ink-jet printing method.

As shown in FIG. 1, the unwinder 10 has a roll support shaft 11, a brake 12, and a guide roller 13. The roll support shaft 11 rotatably supports the rolled continuous paper P. The rolled continuous paper P, when unwound, is rotated along with the roll support shaft 11. The brake 12 is a member to apply the brake on the rotation of the roll support shaft 11. The brake 12 is configured with e.g. a powder brake. By application of the brake with the brake 12 on the rotation of the roll support shaft 11, tension is applied between the rolled continuous paper P and a pair of conveyance rollers 34 to be described later. The guide roller 13 guides the unwound continuous paper P, about the front-and-back direction as a longitudinal direction (axial direction). Note that the unwinder 10 further has a frame indicated with an alternate-long-and-two-short-dash line and a motor (unshown) to drive the brake 12.

As shown in FIG. 1, the printing part 20 has a head unit 21, a circulating pump 22, a sub tank 23, and an ink supply tank 24. The printing part 20 is provided in the housing 50. The head unit 21, the circulating pump 22, and the sub tank 23 are respectively provided for five colors for front surface printing and five colors for back surface printing. That is, ten head units 21, ten circulating pumps 22, and ten sub tanks 23 are provided. Further, the ink supply tank 24 is provided for five colors, i.e., five ink supply tanks 24 are provided. Note that the colors of ink IK are e.g. black (K), cyan (C), magenta (M), yellow (Y), and a spare color. The spare color is an arbitrary color such as red, light cyan, or gray.

The head unit 21 has an ink-jet head 21*a*, a pressure tank 21*b*, and a negative pressure tank 21*c*. Note that the ten head units 21 are respectively removably provided in the ink-jet printer 1.

The ink IK is supplied from the ink supply tank 24 via the sub tank 23 to the negative pressure tank 21*c*. Further, the ink IK which has not been consumed with the ink-jet head 21*a* is resupplied with the circulating pump 22 via the negative pressure tank 21*c* and the pressure tank 21*b* to the ink-jet head 21*a*. In this manner, the printing part 20 is a circulation type printing part in which the ink IK is circulated. However, the printing part 20 may be a non-circulation type printing part.

As shown in FIG. 1, the conveyance unit 30 has guide rollers 31*a* to 31*j* as conveyance members, a meandering controller 32, a support member 33, and the pair of conveyance rollers 34. The conveyance unit 30 is provided in the housing 50.

The guide rollers 31*a* to 31*j* guide the continuous paper P unwound from the unwinder 10 in the housing 50, about the front-and-back direction as a longitudinal direction (axial direction). The guide rollers 31*a*, 31*b* guide the continuous paper P between the unwinder 10 and the meandering controller 32. The guide rollers 31C to 31*i* guide the continuous paper P between the meandering controller 32 and the pair of conveyance rollers 34. The guide roller 31*j* guides the continuous paper P between the pair of conveyance rollers 34 and the winder 40.

The meandering controller 32, having meandering control rollers 32*a* and 32*b*, corrects meandering of the continuous paper P. The meandering control rollers 32*a* and 32*b* operate about the front-and-back direction as a longitudinal direction (axial direction). The meandering controller 32 controls the inclination of the continuous paper P with respect to the front-and-back direction based on the meandering state of the continuous paper P detected with an unshown sensor.

Two support members 33, which operate about the front-and-back direction as a longitudinal direction (axial direction), are provided under the respective head units 21. The ten support members 33 are provided so as to draw an upward arch respectively between the guide rollers 31*d* and 31*e* and between the guide rollers 31*f* and 31*g*. In this configuration, tension acts on the continuous paper P respectively between the guide rollers 31*d* and 31*e* and between the guide rollers 31*f* and 31*g*, and the stable posture of the continuous paper P is maintained.

The pair of conveyance rollers 34 nip and convey the continuous paper P by driving of an unshown motor (an example of conveyance driving member (actuator)).

As shown in FIG. 1, the winder 40 has a winding shaft 41, a winding motor 42, and a guide roller 43. The winding shaft 41 winds the continuous paper P in roll shape. Note that the wound continuous paper P is subjected to post-processing such as cutting. The winding motor 42 is another example of the conveyance driving member (actuator). The winding motor 42 rotates the winding shaft 41 clockwise in FIG. 1. The guide roller 43 guides the continuous paper P immediately before winding with the winding shaft 41, about the front-and-back direction as a longitudinal direction (axial direction). Note that the winder 40 further has a frame indicated with an alternate-long-and-two-short-dash line.

As shown in FIG. 1, the ink-jet printer 1 is provided with two dust removal devices 100. These two dust removal devices 100 are provided in predetermined space as a left lower part in the housing 50 of the ink-jet printer 1. In this space, the continuous paper P is put around the guide rollers 31*b* and 31*c* and the meandering control rollers 32*a* and 32*b* of the meandering controller 32. With this setting of the continuous paper P, the conveyance direction of the continuous paper P is changed. The continuous paper P takes horizontal posture in an upstream position between the guide roller 31*b* and the meandering control roller 32*a* and in a downstream position between the meandering control roller 32*b* and the guide roller 31*c*. The upstream position and the downstream position are arrayed in the up-and-down direction. In the upstream position, the back surface (the inside of the roll) of the continuous paper P is the lower side surface. In the downstream position, the front surface (the outside of the roll) of the continuous paper P is the lower side surface. The two dust removal devices 100 are arrayed in the up-and-down direction so as to be in contact with the lower side surface of the continuous paper P, i.e., the back surface and the front surface of the continuous paper P in the upstream position and the downstream position. Note that the upstream position and the downstream position in which the two dust removal devices 100 are provided are indicated based on the relative positional relationship between the two dust removal devices 100 with reference to the conveyance direction of the continuous paper P. In the positional relationship with respect to the printing part 20, the two dust removal devices 100 are both on the upstream side of the printing part 20.

The dust removal device 100 has a dust removing member 101 which is a brush to be in contact with the lower surface of the continuous paper P to remove dust from the continuous paper P, and a tray-shaped dust receiving member 102 to which the dust removing member 101 is attached, and which receives the dust removed with the dust removing member 101 from the continuous paper P. The dust removal device 100 is movable between a cleaning position (see FIG. 1) where the dust removing member 101 comes into contact with the lower surface of the continuous paper P and a detachment position where the dust removing member 101 and the dust receiving member 102 move in the vertical direction of the drawing in FIG. 1 out of the housing 50 and the dust removing member 101 is moved away from the lower surface of the continuous paper P. Note that to move the dust removal device 100 from the cleaning position to the detachment position shown in FIG. 1, the operator may hold and pull out the dust removal device 100 in the vertical direction of the drawing (e.g. vertical frontward direction of the drawing) in FIG. 1.

According to the ink-jet printer 1 according to the first embodiment shown in FIG. 1, it is possible to draw the continuous paper P along the conveyance path of the conveyance unit 30 in a state where the two dust removal devices 100 are pulled out of the housing 50 and the dust removal devices 100 do not exist in the predetermined space. Since there is no disturbance of the operation, the work to draw the continuous paper P is easily performed. Thereafter, the two dust removal devices 100 are set in the cleaning position where the dust removal devices 100 are in contact with the lower surface of the continuous paper P. The upper end of the dust removing member 101 in contact with the continuous paper P is pushed down with the continuous paper P and elastically warped to be in a position slightly lower than a predetermined position. Further, the continuous paper P is pushed up with the dust removing member 101 to be in a position slightly upper than a position when the dust removing member 101 does not exist.

When printing is started, the continuous paper P is fed from the unwinder 10, and the continuous paper P, being conveyed with the conveyance unit 30, is subjected to printing with the printing part 20. The printed continuous paper P is further conveyed and wound with the winder 40. Meantime, the dust attached to the back surface and the front surface of the continuous paper P before printing is rubbed with the dust removing members 101 of the two dust removal devices 100 on the upstream side of the printing part 20, and removed from the continuous paper P. The dust removed from the continuous paper P falls and is stored in the dust receiving members 102.

To clean the dust removing member 101, the conveyance and printing of the continuous paper P are stopped, and the dust removal device 100 in the cleaning position in the housing 50 is moved to the detachment position out of the housing 50. That is, the dust removal device 100 is pulled out of the housing 50 of the ink-jet printer 1. Then cleaning is performed by discharging the dust accumulated in the dust receiving member 102 and removing the dust attached to the dust removing member 101. After the cleaning, the dust removal device 100 is inserted in the cleaning position in the housing 50 of the ink-jet printer 1.

In this manner, since the dust removal device according to the present invention is capable of removing dust attached to the continuous paper P, it is advantageous to provide the dust removal device in a printer having a printing principle especially susceptible of the influence of dust. Accordingly, it is greatly advantageous when the dust removal device is provided in the ink-jet printer 1 as in the case of the present embodiment. However, it is not necessary to provide the dust removal device according to the present invention in a printer. It is possible to obtain the advantage of removal of dust attached to the continuous paper as long as the dust removal device is provided in a device to convey continuous paper. With this advantage, it is possible to obtain secondary advantages corresponding to the purpose of conveyance of the continuous paper with the device.

Next, the dust removal device 100 according to a second embodiment will be described with reference to FIG. 2 to FIG. 6.

The dust removal device 100 can be provided in the predetermined space in the housing 50 of the in-jet printer 1. The arrangement of the conveyance path of the continuous paper P, the conveyance rollers as conveyance members and the like is different from that in the first embodiment. In the following description, for the sake of convenience, constituent elements functionally corresponding to those of the first embodiment will have the same reference numerals.

Figure 2:
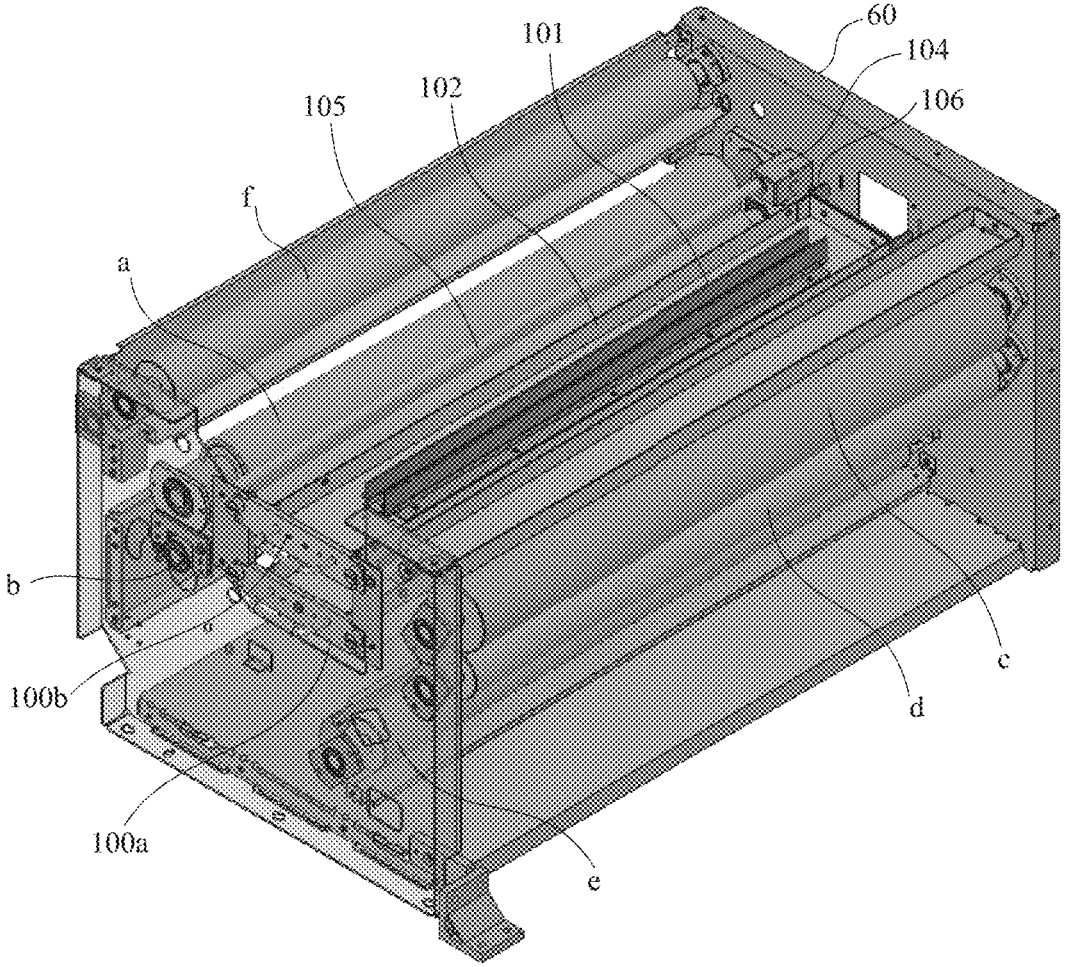
FIG. 2 is a perspective view showing a dust removal device according to a second embodiment of the present invention provided in the ink-jet printer.

As shown in FIG. 2, a frame 60 partitioning the predetermined space is provided with plural guide rollers a to f as conveyance members to convey the continuous paper P. The continuous paper P (unshown) is continuously supplied from the paper supply part on the left side in FIG. 2 rightward, then passed through the guide rollers a and b, and, through the upstream-side cleaning position where a first dust removal device 100*a* is provided, passed through the guide rollers c and d. Further, the direction of the continuous paper P is changed downward, then is changed rightward through the guide roller e in the figure, and is guided to the outside of the frame 60. Thereafter, though not shown in FIG. 2, the continuous paper P is guided upward through the meandering controller 32 shown in FIG. 1, then further, the direction of the continuous paper P is changed so as to return to the upstream side in the horizontal direction (diagonally left side in FIG. 2), then through the downstream-side cleaning position where a second dust removal device 100*b* is provided, passed through the guide roller f, then the direction of the continuous paper P is changed, and the continuous paper P is guided upward.

Figure 3:
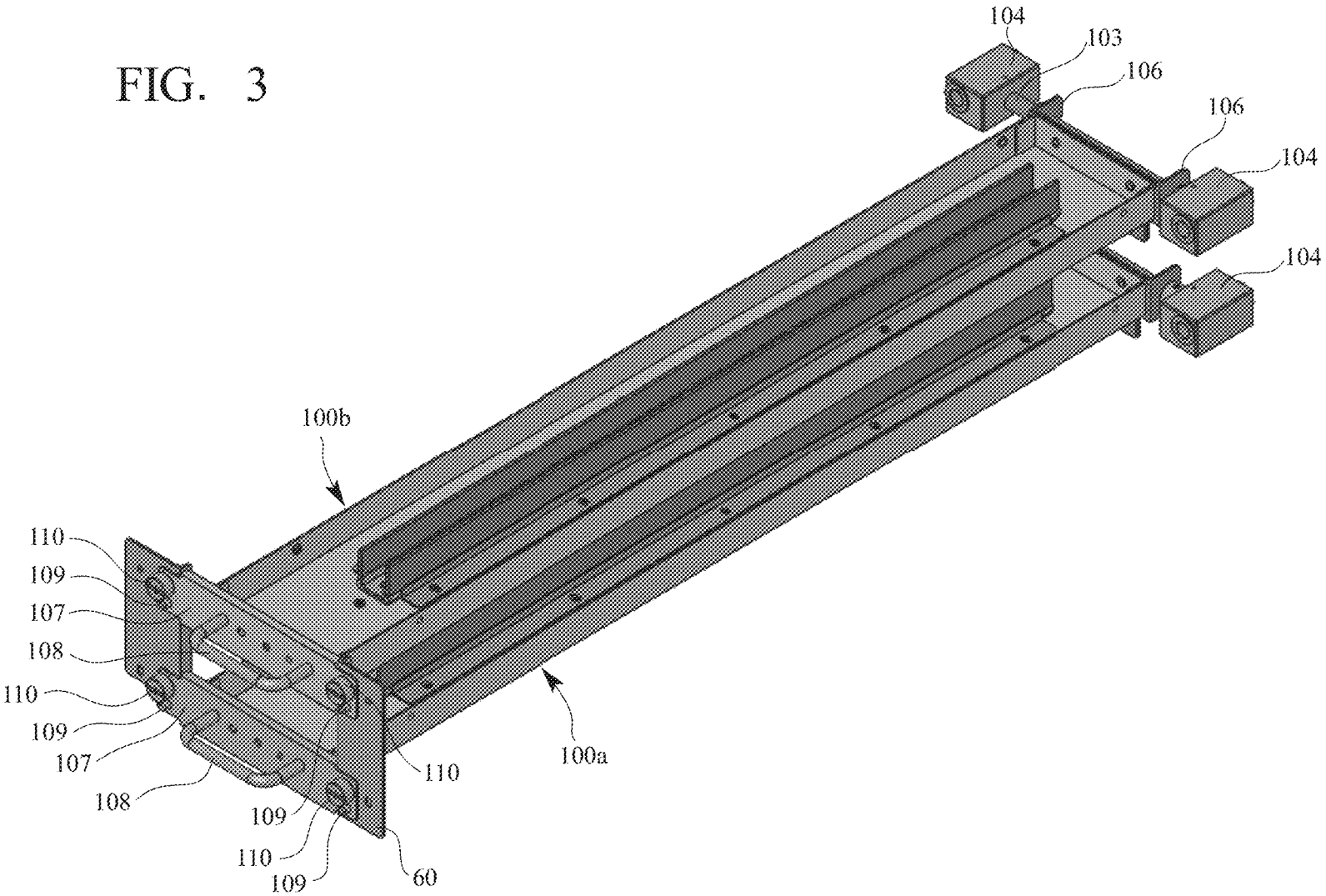
FIG. 3 is a perspective view showing a state where first and second dust removing members are set in cleaning positions in the dust removal device shown in FIG. 2.
Figure 4:
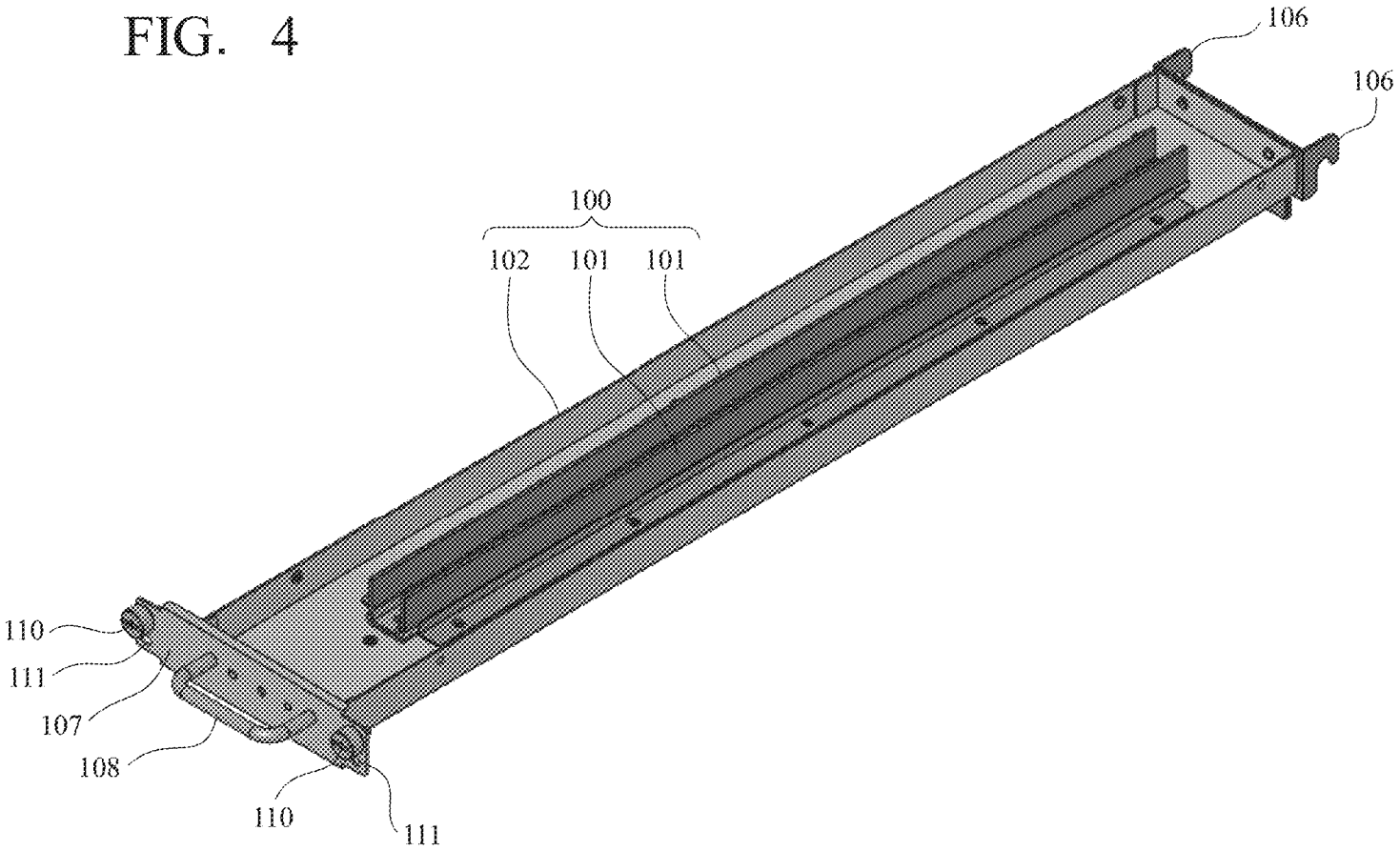
FIG. 4 is a perspective view showing a state where one of the first and second dust removing members shown in FIG. 3 is pulled out of a frame and is separated.

FIG. 3 is a perspective diagram showing a part of the configuration of the dust removal device 100 shown in FIG. 2. The first and second dust removal devices 100*a* and 100*b* are set in the cleaning positions. FIG. 4 is a perspective diagram showing one of the first and second dust removal devices 100 shown in FIG. 3. The dust removal device 100 is pulled out of the frame 60. As shown in these figures, the dust removal device 100 has the dust the receiving member 102 as a shallow rectangular tray, the moving direction of which is a longitudinal direction, and two arrays of dust removing members 101 attached upwardly along the longitudinal direction at the center of the upper surface of the dust receiving member 102. The dust removing member 101 may be configured with a brush or the like. A pair of linear bearings 104 connected with a lateral shaft 103 are provided on the rear side of the dust receiving member 102. The pair of linear bearings 104 are slidably guided with a pair of guide shafts 105 (one of the pair of guide shafts is shown in FIG. 2). A pair of locking members 106 is provided at one end of the dust receiving member 102 on the rear side. The locking member 106 is removably engaged with the lateral shaft 103. A front plate 107 is provided at the other end of the dust receiving member 102 on the front side. A handle 108, which the operator grasps upon movement of the dust removal device 100 along the guide shaft 105, is attached to the front plate 107. Further, the front plate 107 is provided with a positioning hole 111 (see FIG. 4) in which a positioning pin 109 fixed to the frame 60 is inserted, and a fixing screw 110 to fix the front plate 107 in a predetermined position of the frame 60.

Figure 5:
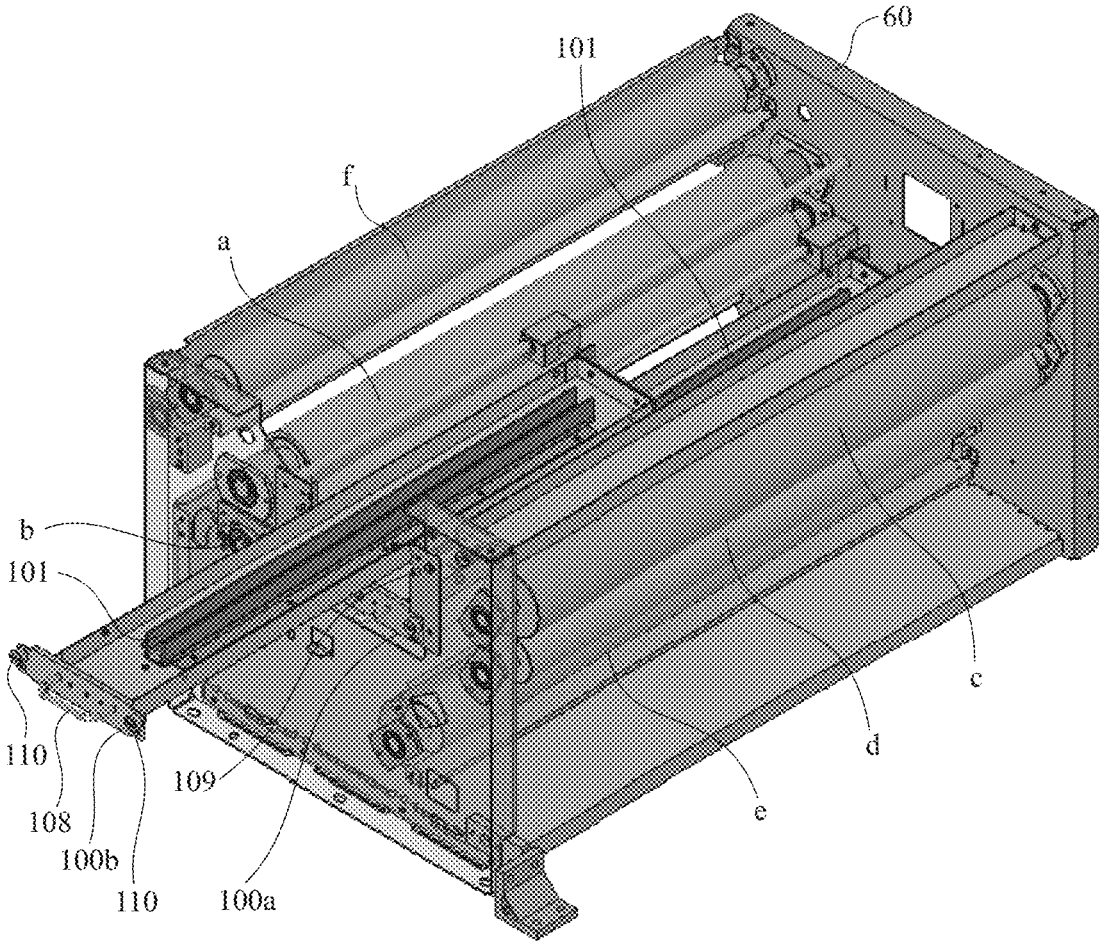
FIG. 5 is a perspective view showing a state where the upper first dust removing member is being moved from the cleaning position toward a detachment position, and the lower second dust removing member is in the cleaning position, in the dust removal device according to the second embodiment.
Figure 6:
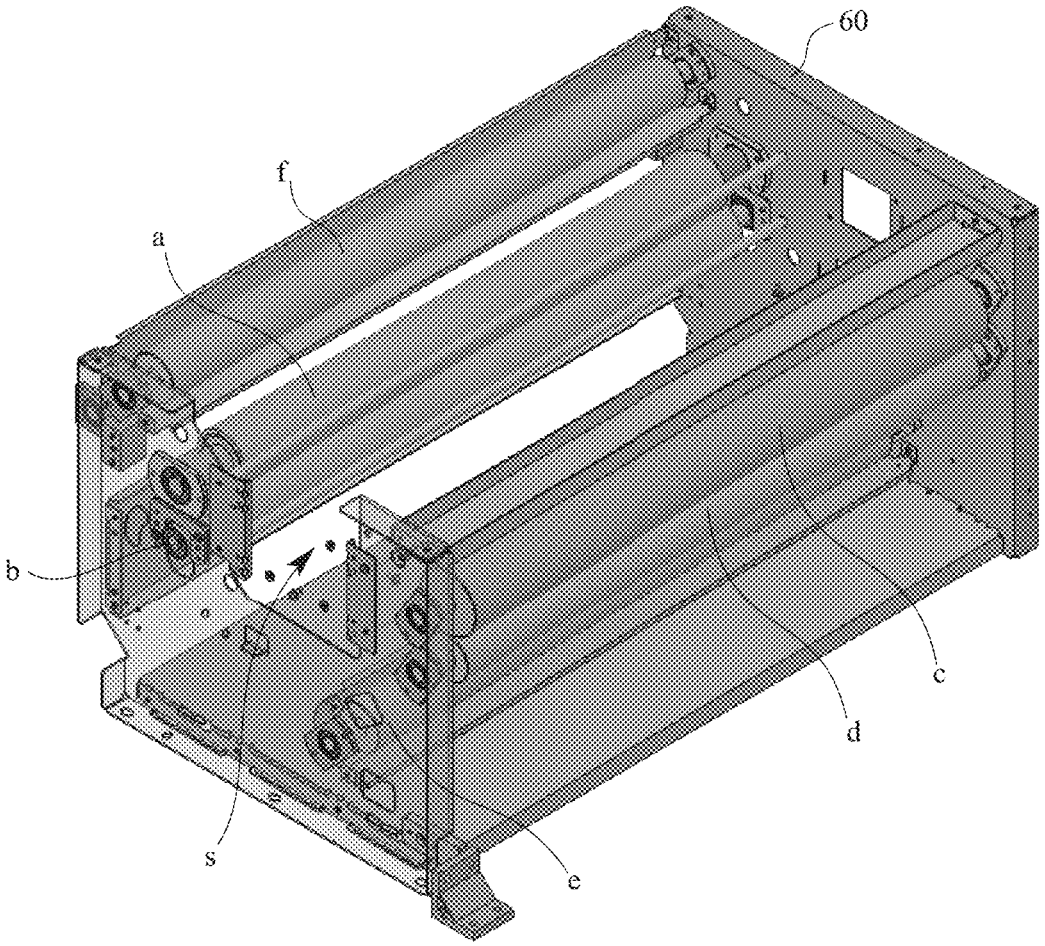
FIG. 6 is a perspective view showing a state where the upper first dust removing member and the lower second dust removing member are both pulled out of the frame and separated, in the dust removal device according to the second embodiment.

FIG. 5 shows a state where the lower-stage first dust removal device 100*a* is in the cleaning position, and the upper-stage second dust removal device 100*b* is in the middle of movement from the cleaning position toward the detachment position. FIG. 6 shows a state where both of the lower-stage first dust removal device 100*a* and the upper-stage second dust removal device 100*b* are pulled out in the detachment position outside of the frame 60, and not shown in the figure. As described in the first embodiment, according to the second embodiment, it is possible to pull the two dust removal devices 100*a* and 100*b* arrayed in the up-and-down direction out of the frame 60 and to ensure widely open space S (see FIG. 6) in the frame 60. It is therefore possible to draw the continuous paper P along the conveyance path of the conveyance unit 30 (including the guide rollers a to f) with time to spare. Thereafter, the two dust removal devices 100*a* and 100*b* are set in the cleaning positions, then the dust removing members 101 are brought into contact with the lower surface of the continuous paper P, and the conveyance of the continuous paper P is started. Dust attached to the back surface and the front surface of the continuous paper P is rubbed with the dust removing members 101 of the two dust removal devices 100*a* and 100*b* and removed from the continuous paper P. The dust removed from the continuous paper P is stored in the dust receiving members 102.

To clean the dust removal devices 100*a* and 100*b*, the operator stops the conveyance of the continuous paper P, removes the fixing screw 110, and grasps the handle 108, to pull the dust removal device 100 in the cleaning position in the frame 60 to the detachment position outside of the frame 60. Then the operator disposes the dust accumulated in the dust receiving member 102, sweeps away the dust attached to the dust removing member 101, thus performing cleaning. After the cleaning, the operator inserts the dust removal devices 100*a* and 100*b* in the cleaning positions in the frame 60.

Next, the dust removal device 100 according to a third embodiment will be described with reference to FIG. 7 to FIG. 9.

The dust removal device 100 can be provided in the predetermined space in the housing 50 of the ink-jet printer 1 according to the first embodiment or the predetermined space in the frame 60 in an apparatus according to the second embodiment. The configurations of the conveyance path of the continuous paper P, the guide roller as a conveyance member, the guide rollers, and the like are different from the configurations of these constituent elements in the first and second embodiments. In the following description, for the sake of convenience, constituent elements corresponding to those of the first embodiment will have the same reference numerals.

The dust removal device 100 is configured such that, in correspondence with configuration of a printer to which the dust removal device 100 is applied, type of the continuous paper P to be conveyed, or the like, various function rollers are arbitrarily added to the conveyance member, and the conveyance path is changed. Further, the first dust removal device 100*a* on the upstream side is provided relatively on the upper side and is in contact with the front surface of the continuous paper P, and the second dust removal device 100*b* is provided relatively on the lower side and is in contact with the back surface of the continuous paper P. As described below, the correspondence between the respective dust removal devices 100*a* and 100*b* and the front and back surfaces of the continuous paper P does not change regardless whether or not the conveyance path is changed by addition of function rollers.

Figure 7:
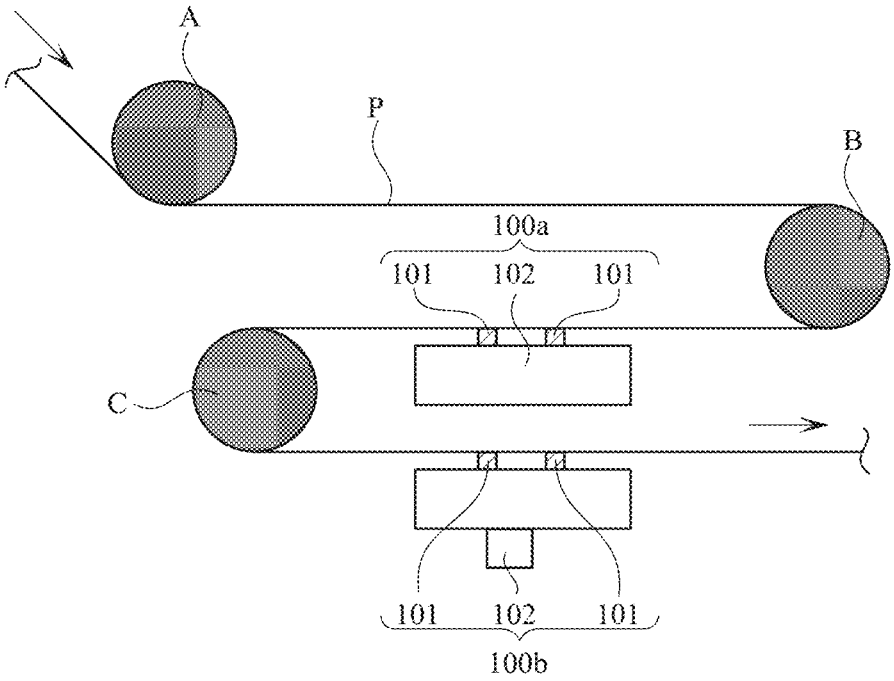
FIG. 7 is a schematic front view showing a basic structure of a conveyance member in the dust removal device according to a third embodiment of the present invention.

FIG. 7 is a schematic front view showing a basic structure of the conveyance member in the dust removal device 100 according to the third embodiment. The continuous paper P is continuously supplied from the paper supply part on the left side in the figure rightward as indicated with an arrow, passed through guide rollers A and B and the direction of the continuous paper P is reversed leftward, and through the upstream-side and relatively upper side cleaning position where the first dust removal device 100*a* is provided, passed through the guide roller C. The direction of the continuous paper P is reversed rightward with the guide roller C, and through the downstream-side and relatively lower side cleaning position where the second dust removal device 100*b* is provided, guided to the downstream side unshown in FIG. 7.

In the dust removal device 100, the upstream-side first dust removal device 100*a* is always in contact with the front surface of the continuous paper P and cleans the front surface. The downstream-side second dust removal device 100*b* is always in contact with the back surface of the continuous paper P and cleans the back surface.

Figure 8:
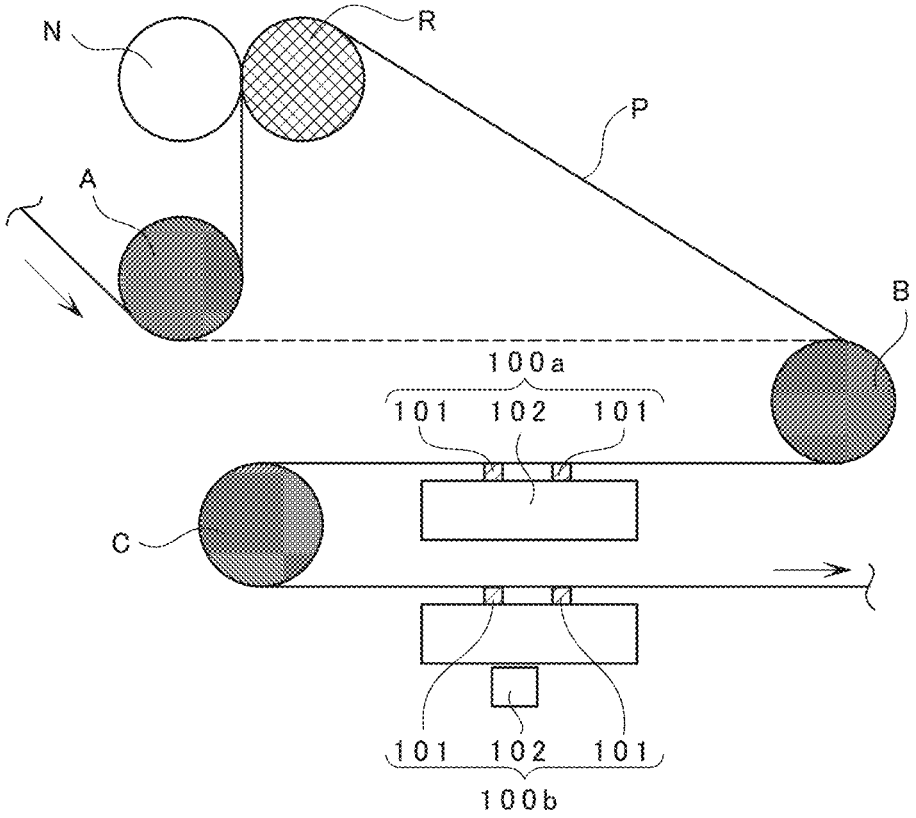
FIG. 8 is a schematic front view showing a first modification of the conveyance member in the dust removal device according to the third embodiment.

FIG. 8 is a schematic front view showing a first modification of the conveyance member in the dust removal device according to the third embodiment. The first modification is configured such that in the basic configuration shown in FIG. 7, a nip roller N and a brake roller R are added between the guide rollers A and B. In the first embodiment shown in FIG. 1, the brake 12 is provided in the unwinder 10 to apply tension to the continuous paper P. In an ink-jet printer without this brake 12 requires a member to apply the brake to the continuous paper P in any position in the conveyance path. In the third embodiment and the first modification having the nip roller N and the brake roller R, since it is possible to apply tension to the continuous paper P, the dust removal device is preferably applicable to the ink-jet printer 1 which lacks the brake 12.

Even in the configuration of the conveyance member shown in FIG. 8, the upstream-side first dust removal device 100*a* is always in contact with the front surface of the continuous paper P and cleans the front surface, and the downstream-side second dust removal device 100*b* is always in contact with the back surface of the continuous paper P and cleans the back surface.

Figure 9:
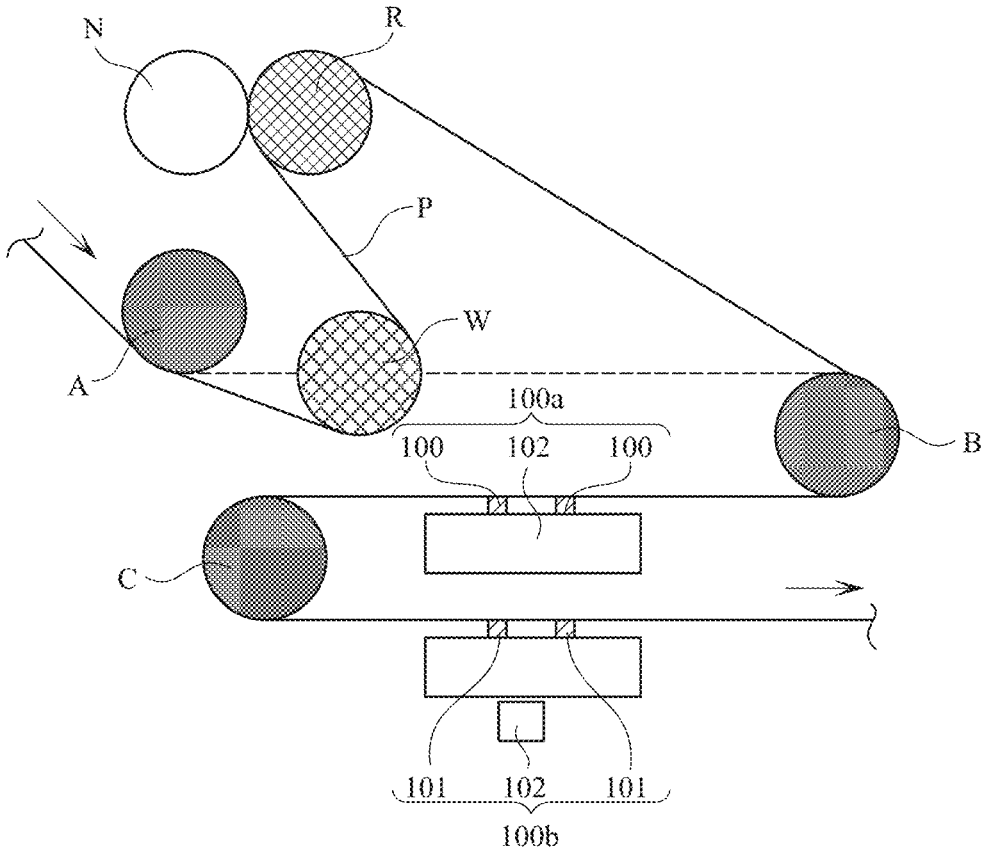
FIG. 9 is a schematic front view showing a second modification of the conveyance member in the dust removal device according to the third embodiment.

FIG. 9 is a schematic front view showing a second modification of the conveyance member in the dust removal device according to the third embodiment. The second modification is configured such that in the first modification shown in FIG. 8, a wrinkle reduction roller W is added between the guide roller A and the brake roller R. When the continuous paper P which is thin and easily becomes wrinkly is conveyed, there is a possibility of fixing wrinkles by holding the continuous paper P with the brake roller R and the nip roller N. Accordingly, the wrinkles caused in the conveyed continuous paper P are stretched with the wrinkle reduction roller W, then the continuous paper P is guided between the brake roller R and the nip roller N, thus fixation of the wrinkles is prevented.

Even in the configuration of the conveyance member shown in FIG. 9, the upstream-side first dust removal device 100*a* is always in contact with the front surface of the continuous paper P and cleans the front surface, and the downstream-side second dust removal device 100*b* is always in constant with the back surface of the continuous paper P and cleans the back surface.

As described above, according to the dust removal devices 100*a* and 100*b* according to the third embodiment shown in FIG. 7 to FIG. 9, the upstream-side first dust removal device 100*a* always cleans the front surface of the continuous paper P, and the downstream-side second dust removal device 100*b* always cleans the back surface of the continuous paper P regardless whether or not the conveyance path is changed by addition of function rollers. The correspondence between the respective dust removal devices 100*a* and 100*b* and the front and back surfaces of the continuous paper P does not change.

There is a possibility that one of the front surface and the back surface of the continuous paper P is dirtier with dust than the other one, depending of the type of conveyed continuous paper P. As long as the correspondence between the two dust removal devices and the front and back surfaces of the continuous paper P is always constant, when it is configured such that the maintenance period for one dust removal device, in which it is conceivable that more dust is stored in a constant period and the maintenance period of the other dust removal device are different, it is easier and more efficient to perform the work. Even when function rollers are added to the conveyance member in accordance with configuration of the printer, to which the dust removal device is applied, or type of conveyed continuous paper P, and the like, and the conveyance path is changed with the addition of the function rollers, the correspondence between the two dust removal devices and the front and back surfaces of the continuous paper P is always constant. Accordingly, the advantage is not changed.

As described above, in the respective embodiments described with reference to FIG. 1 to FIG. 9, the dust removing member 101 comes into contact with the lower surface of the continuous paper P. However, in the present invention, the dust removing member 101 may come into contact with the upper surface of the continuous paper P. For example, in the embodiment shown in FIG. 7 to FIG. 9, it may be configured such that the first dust removal device 100*a* and the second dust removal device 100*b* are provided, in upside down posture, on the upper side of the continuous paper P with which the dust removal devices are in contact, and the respective dust removing members 101 come into contact with the upper surface of the continuous paper P. In this case, the dust receiving member 102 is not indispensable. However, it is necessary to respectively provide a paper powder processing member to be in contact with the continuous paper P on the downstream side of the respective dust removing members 101, and to integrate the dust removing members 101 with the paper powder processing member so as to be movable between the cleaning position and the detachment position. Note that the paper powder processing member has a function of infallibly processing paper powder separated from the upper surface of the continuous paper P and removing the paper powder from the continuous paper P without disturbing conveyance of the continuous paper P. As this paper powder processing member, a paper powder adhesive member which has an appropriate adhesive force and which is provided to be in contact with the continuous paper P may be used. Otherwise, a paper powder suction device which sucks only paper powder from the continuous paper P by air suction may be used.

«Configurations and Advantages of Dust Removal Device and Printer According to Respective Aspects in Embodiments»

The characteristic feature of the dust removal device 100 according to the first aspect is that the dust removal device 100 has the dust removing member 101 movable between the cleaning position where the dust removing member 101 is in contact with the continuous paper P conveyed in horizontal posture in the predetermined space S and the detachment position away from the space S.

To remove dust attached to the continuous paper P with the dust removal device 100 according to the first aspect, the dust removing member 101 is set in the cleaning position where the dust removing member 101 is in contact with the continuous paper P in horizontal posture, and conveyance of the continuous paper P is started. The dust attached to the continuous paper P is rubbed with the dust removing member 101 in accordance with conveyance of the continuous paper P and is removed from the continuous paper P. To clean the dust removing member 101, in a state where the conveyance of the continuous paper P is stopped, the dust removing member 101 in the cleaning position is moved to the detachment position. The dust removing member 101 is moved out of the predetermined space S, then released from the contact with the continuous paper P. Since the dust removing member 101 does not interfere with the continuous paper P, it is possible to easily clean the dust removing member dirty with the dust. Further, by moving the dust removing member 101 to the detachment position, the predetermined space S becomes empty. It is possible to easily perform the work to set the continuous paper.

The characteristic feature of the dust removal device 100 according to the second aspect is that the dust removing member 101 is in contact with the lower surface of the continuous paper P in the cleaning position, and that the dust receiving member 102 that receives dust removed with the dust removing member 101 from the lower surface of the continuous paper P is attached to the dust removing member 101.

According to the dust removal device 100 according to the second aspect, the dust removed with the dust removing member 101 from the lower surface of the continuous paper P falls, without scattering in the space S, to the dust receiving member 102 and stored in the dust receiving member 102. It is therefore possible to move the dust removing member 101 to the detachment position, collect the dust removing member 101 outside of the apparatus, and dispose the dust removing member 101.

The characteristic feature of the dust removal device 100 according to the third aspect is that the dust removal device 100 further has the conveyance member that conveys the continuous paper P in the space S such that in a part of the continuous paper P conveyed in horizontal posture, the first surface is the lower surface, and in another part of the continuous paper P conveyed in horizontal posture, the second surface is the lower surface, and that the dust removal device 100 includes the first dust removal device 100*a* using the lower side of the part of the continuous paper P in the space S as the cleaning position, and the second dust removal device 100*b* using the other part of the continuous paper P in the space S as the cleaning position.

According to the dust removal device 100 according to the third aspect, it is possible to perform cleaning with the first dust removal device 100*a* and the second dust removal device 100*b*, with the front surface and the back surface of the continuous paper P respectively directed downward. It is therefore possible to infallibly remove dust from the front and back surfaces of the continuous paper P, and infallibly collect and dispose the dust. Especially, when these two dust removal devices 100*a* and 100*b* are provided in close proximity with each other in the up-and-down direction or the like, the space S in which the two dust removal devices 100*a* and 100*b* are provided is larger in comparison with a case where the two dust removal devices 100*a* and 100*b* are provided in different positions away from each other. It is therefore possible to easily perform the work to draw the continuous paper P in the space S.

The characteristic feature of the dust removal device 100 according to the fourth aspect is that the conveyance member is configured to be capable of changing the conveyance path to convey the continuous paper P, and that, regardless of whether the conveyance path is changed or not, the first dust removal device 100*a* is always in contact with the first surface of the continuous paper P, and the second dust removal device 100*b* is always in contact with the second surface of the continuous paper P.

According to the dust removal device 100 according to the fourth aspect, it is possible to arbitrarily add various function rollers to the conveyance member and change the conveyance path in correspondence with configuration of a printer to which the dust removal device 100 is applied, type of the continuous paper P to be conveyed, or the like. Further, the first dust removal device 100*a* is always in contact with one surface (e.g., the front surface) of the continuous paper P, and the second dust removal device 100*b* is always in contact with the other surface (e.g., the back surface) of the continuous paper P. When it is configured such that the maintenance period for the dust removal devices 100*a* and 100*b* in which it is conceivable that more dust is stored in a constant period is different from the maintenance period for the other dust removal devices 100*b* and 100*a*, it is easier and more efficient to perform the work. Further, this advantage does not change regardless of whether or not the conveyance path is changed by addition of function rollers.

The characteristic feature of the printer 1 according to the aspects is that the printer 1 has the paper supply part 10 that feeds the continuous paper P, the printing part 20 that performs printing on the continuous paper P fed from the paper supply part 10, the winder 40 that winds the printed continuous paper P, and the dust removing member 101 movable between the cleaning position, where the dust removing member 101 is in contact with the continuous paper P conveyed in horizontal posture in the predetermined space S including a part of the conveyance path of the continuous paper P from the paper supply part 10 to the printing part 20, and the detachment position away from the space S.

According to the printer 1 according to the aspects, the dust removing member 101 is pulled out of the space S to the outside, and in a state where the dust removing member 101 does not exist in the space S, the continuous paper P is drawn along the conveyance path. Since there is no disturbance of the operation in the space S, the work to draw the continuous paper P is easily performed. Next, the dust removing member 101 is set in the cleaning position where the dust removing member 101 is in contact with the continuous paper P, and printing is started. Dust attached to the continuous paper P fed from the paper supply part 10 is infallibly removed with the dust removing member 101. Thereafter, the continuous paper P is subjected to printing with the printing part 20, and wound with the winder 40. It is possible to prevent inconvenience in the printing part 20 at least due to dust removed with the dust removing member 101, and regarding the dust removal with the dust removing member 101, it is possible to improve the printing quality.

DESCRIPTION OF REFERENCE SIGNS

1: ink-jet printer as a printer
10: unwinder 10 as a paper supply part
20: printing part
30: conveyance unit
31*a* to 31*j*: guide rollers configuring conveyance units
32: meandering controller
34: conveyance roller
40: winder as a winding part
50: housing
60: frame
100: dust removal device
100*a*: first dust removal device
100*b*: second dust removal device
101: dust removing member
102: dust receiving member
P: continuous paper
S: space
a to f, A to C: guide roller
N: nip roller as a conveyance member
R: brake roller as a conveyance member
W: wrinkle reduction roller as a conveyance member

What is claimed is:

1. A dust removal device comprising:

a dust remover that is movable in a horizontal direction perpendicular to a conveyance direction of a continuous medium between a cleaning position, where the dust remover is in contact with the continuous medium conveyed in a horizontal posture in a predetermined space, and a detachment position away from the predetermined space.

2. A dust removal device comprising:

a dust remover that is movable between a cleaning position, where the dust remover is in contact with a continuous medium conveyed in a horizontal posture in a predetermined space, and a detachment position away from the predetermined space; and a dust receiver that is attached to the dust remover and that receives dust removed with the dust remover, wherein the dust remover is in contact with a lower surface of the continuous medium in the cleaning position, and the dust receiver receives the dust removed with the dust remover from the lower surface of the continuous medium.

3. The dust removal device according to claim 2, further comprising a conveyor that conveys the continuous medium in the predetermined space such that in a part of the continuous medium conveyed in the horizontal posture, a first surface is the lower surface, and in another part of the continuous medium conveyed in the horizontal posture, a second surface is the lower surface, wherein the dust remover includes a first dust remover using a lower side of the part of the continuous medium in the predetermined space as a first cleaning position, and a second dust remover using a lower side of the other part of the continuous medium in the predetermined space as a second cleaning position.

4. The dust removal device according to claim 3, wherein the conveyor is configured to change a conveyance path to convey the continuous medium, and wherein, regardless of whether the conveyance path is changed or not, the first dust remover is always in contact with the first surface of the continuous medium, and the second dust remover is always in contact with the second surface of the continuous medium.

5. A printer comprising:

a medium supplier part that feeds a continuous medium;

a printer part that performs printing on the continuous medium fed from the medium supplier part;

a winder part that winds the printed continuous medium; and a dust remover that is movable in a horizontal direction perpendicular to a conveyance direction of the continuous medium between a cleaning position, where the dust remover is in contact with the continuous medium conveyed in a horizontal posture in a predetermined space including a part of a conveyance path of the continuous medium from the medium supplier part to the printer part, and a detachment position away from the predetermined space.

6. The dust removal device according to claim 1, further comprising:

a printer part that performs printing on the continuous medium, wherein, the dust remover is independently movable relative to the printer part.

* * * * *